US010173422B2

(12) United States Patent
Itayama

(10) Patent No.: US 10,173,422 B2
(45) Date of Patent: Jan. 8, 2019

(54) LIQUID EJECTING HEAD AND LIQUID EJECTING APPARATUS

(71) Applicant: SEIKO EPSON CORPORATION, Tokyo (JP)

(72) Inventor: Yasuhiro Itayama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/896,401

(22) Filed: Feb. 14, 2018

(65) Prior Publication Data

US 2018/0229501 A1 Aug. 16, 2018

(30) Foreign Application Priority Data

Feb. 16, 2017 (JP) ..... 2017-027324

(51) Int. Cl.

| | |
|---|---|
| ***B41J 2/14*** | (2006.01) |
| ***B41J 2/045*** | (2006.01) |
| ***B41J 2/055*** | (2006.01) |
| ***B41J 2/16*** | (2006.01) |

(52) U.S. Cl.

CPC ..... *B41J 2/14274* (2013.01); *B41J 2/04581* (2013.01); *B41J 2/055* (2013.01); *B41J 2/14233* (2013.01); *B41J 2/161* (2013.01); *B41J 2/1623* (2013.01); *B41J 2/1628* (2013.01); *B41J 2/1629* (2013.01); *B41J 2/1632* (2013.01); *B41J 2/1635* (2013.01); *B41J 2/1642* (2013.01); *B41J 2/1645* (2013.01); *B41J 2/1646* (2013.01); *B41J 2002/14241* (2013.01); *B41J 2002/14306* (2013.01); *B41J 2002/14419* (2013.01); *B41J 2202/11* (2013.01)

(58) Field of Classification Search

CPC .... B41J 2/04581; B41J 2/14233; B41J 2/161; B41J 2/1623; B41J 2/1628; B41J 2/1629; B41J 2/1632; B41J 2/1635; B41J 2/1642; B41J 2/1645; B41J 2/1646; B41J 2/14274

See application file for complete search history.

(56) References Cited

U.S. PATENT DOCUMENTS

2014/0132676 A1* 5/2014 Yazaki ..... B41J 2/14201 347/71

FOREIGN PATENT DOCUMENTS

| | | |
|---|---|---|
| JP | H11-105281 A | 4/1999 |
| JP | 2013-95088 A | 5/2013 |
| JP | 2015-104911 A | 6/2015 |

* cited by examiner

*Primary Examiner* — Juanita D Jackson

(74) *Attorney, Agent, or Firm* — Workman Nydegger

(57) ABSTRACT

A liquid ejecting head includes a flow channel substrate and piezoelectric elements, with a diaphragm between the piezoelectric elements and the flow channel substrate. The flow channel substrate has pressure chambers lined up in a first direction with walls therebetween. Each piezoelectric element includes a first electrode, a piezoelectric layer and a second electrode. Each piezoelectric element has a piezoelectrically active portion, a region in which the piezoelectric layer is sandwiched between the first electrode and the second electrode, and are provided in regions facing the pressure chambers. The liquid ejecting head further includes holding members joined the diaphragm facing the walls using an adhesive agent. The width of the holding members is equivalent to or larger than the width of the walls. The width of an adhesive agent with which the holding members are joined to the diaphragm is equal to or smaller than the width of the walls.

8 Claims, 10 Drawing Sheets

LIQUID EJECTING HEAD AND LIQUID EJECTING APPARATUS

This application claims priority under 35 U.S.C. § 119 to Japanese Patent Application No. 2017-027324 filed on Feb. 16, 2017, the entire disclosure of which is expressly incorporated by reference herein.

BACKGROUND

1. Technical Field

The present invention relates to a liquid ejecting head and a liquid ejecting apparatus both of which eject liquid droplets by deforming piezoelectric elements.

2. Related Art

Liquid ejecting heads are hitherto known that deform piezoelectric elements (actuators) to cause a pressure change to liquid in pressure chambers and thereby eject liquid droplets through nozzles that communicate with the pressure chambers. A representative example is an ink jet recording head, which ejects ink droplets as the liquid droplets.

An ink jet recording head has, for example, a flow channel substrate and piezoelectric elements on one side of the flow channel substrate. The pressure chambers communicate with nozzle openings, and the piezoelectric elements are driven to deform a diaphragm to cause a pressure change to the pressure chambers, thereby ejecting ink droplets through the nozzles.

The piezoelectric elements are composed of a first electrode on a diaphragm, a piezoelectric layer, and a second electrode (e.g., see JP-A-11-105281). Such piezoelectric elements are provided in the regions of the diaphragm facing the pressure chambers. At the sides, in the direction of the short sides of the piezoelectric elements, of the regions facing the pressure chambers, regions in which the diaphragm is the only component extend. These regions called arms.

When voltage is applied across the first electrode and the second electrode, this type of piezoelectric element experiences stress concentration at the boundaries between the portions of the piezoelectric layer in which piezoelectric strain occurs (active portions) and the portions in which no piezoelectric strain occurs (piezoelectrically inactive portions). In the diaphragm, tear stress is concentrated, on the side of its arms opposite the piezoelectric elements, at the portions facing the corners formed between the pressure chambers and the walls defining the pressure chambers, unfortunately causing cracks and other defects.

Such a problem is not unique to ink jet recording heads. Similar problems may also be encountered with liquid ejecting heads that eject liquids other than ink.

SUMMARY

An advantage of some aspects of the invention is that they provide a liquid ejecting head and a liquid ejecting apparatus in which stress concentration at the portions of a diaphragm's arms facing the corners of pressure chambers is milder and, as a result, the diaphragm is prevented from cracking.

An aspect of the invention provides a liquid ejecting head that includes a flow channel substrate and piezoelectric elements on one side of the flow channel substrate, with a diaphragm between the piezoelectric elements and the flow channel substrate. The flow channel substrate has pressure chambers lined up in a first direction with walls therebetween. The pressure chambers communicate with nozzle openings, openings through which the liquid is ejected. Each piezoelectric element includes a first electrode, a piezoelectric layer above the first electrode, and a second electrode above the piezoelectric layer. Each piezoelectric element has a piezoelectrically active portion, a region in which the piezoelectric layer is sandwiched between the first electrode and the second electrode, and the piezoelectrically active portions are provided in the regions facing the pressure chambers. The liquid ejecting head further includes holding members joined one-to-one to the regions of the diaphragm facing the walls between the pressure chambers. The width, or the dimension measured in the first direction, of the holding members is equivalent to or larger than the width of the walls. The width, or the length measured in the first direction, of the adhesive agent with which the holding members are joined to the diaphragm is equal to or smaller than the width of the walls.

In this aspect of the invention, the maximum principal stress that the arms, or the regions of the diaphragm extending at the sides in the first direction, undergo in the vicinity of the boundaries between the pressure chambers and the walls when the piezoelectrically active portions are driven is reduced by the holding members. As a result, the diaphragm is prevented from cracking.

It is preferred that the liquid ejecting head further include a protective substrate joined to the side of the flow channel substrate on which the piezoelectric elements are provided, the protective substrate including a piezoelectric element housing, a space in which the piezoelectric elements are housed, and that the holding members be provided on the protective substrate, whether integral with or separate from the protective substrate. This makes it relatively easy to provide the holding members.

It is preferred that the proportion $W_3/W_1$, where $W_3$ is the dimension measured in the first direction of the portions of the holding members sticking out beyond the edges of the walls to the pressure chamber side, and $W_1$ is the width of the walls, be 0.02 or more and 0.50 or less. Besides reducing the maximum principal stress the arms undergo in the vicinity of the boundaries between the pressure chambers and the walls, this will move stress raisers from the corners, at which the pressure chambers and the walls meet, to the regions facing the pressure chambers, further reducing the occurrence of cracks.

It is preferred that the side walls, or the walls on the sides in the first direction, of the holding members and the interfaces between the holding members and the diaphragm form an angle of 10° or more and 135° or less in the vicinity of the interfaces. This ensures that the magnitude of the maximum principal stress can be changed by varying the angle between the side walls and the interfaces.

Another aspect of the invention is a liquid ejecting apparatus that includes a liquid ejecting head described above.

In this aspect of the invention, a liquid ejecting apparatus is provided that is advantageous in that the maximum principal stress that the arms, or the regions of the diaphragm extending at the sides in the first direction, undergo in the vicinity of the boundaries between the pressure chambers and the walls when the piezoelectrically active portions are driven is reduced by the holding members, and as a result, the diaphragm is prevented from cracking.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
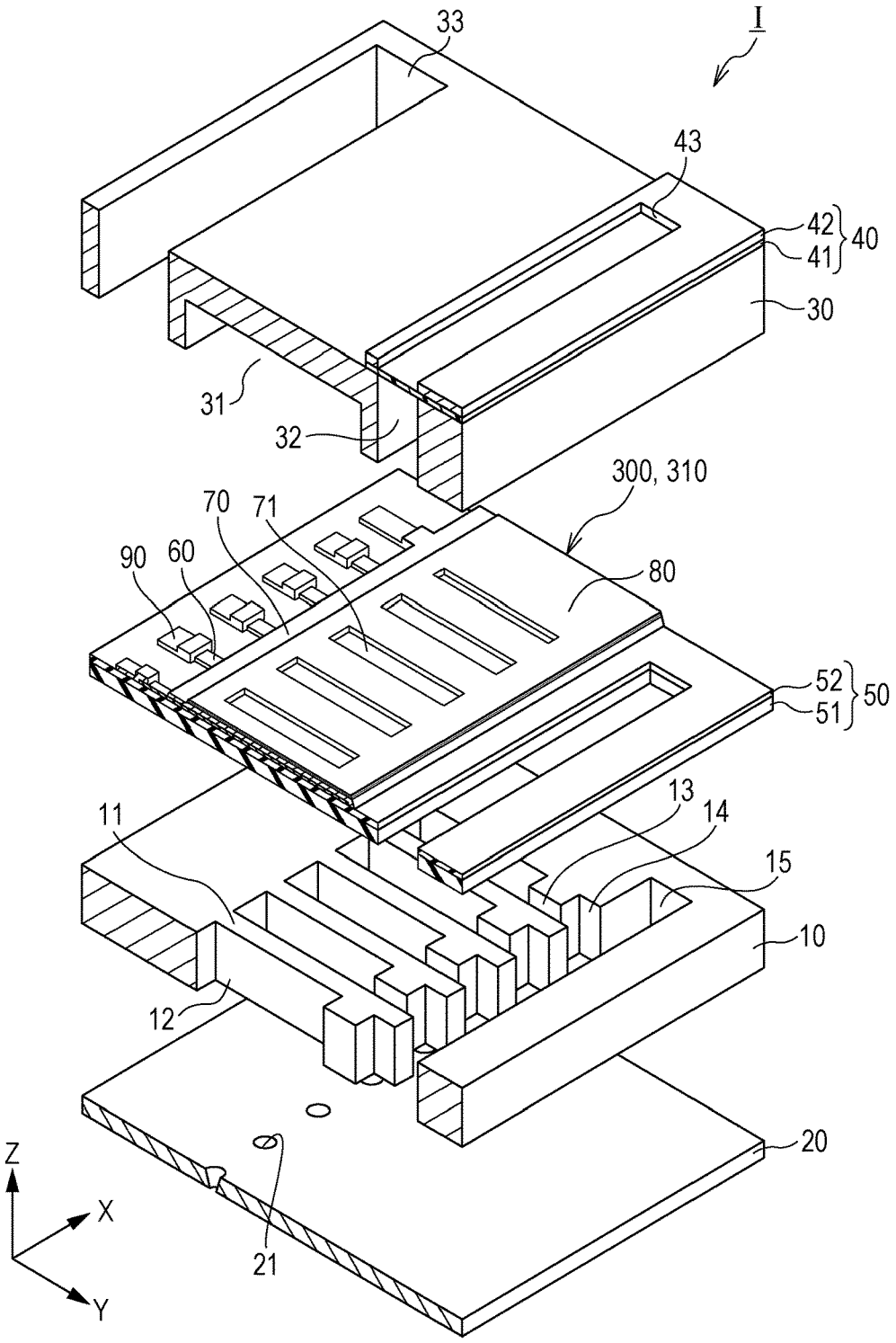
FIG. 1 is an exploded perspective view of a recording head according to Embodiment 1 of the invention.

The following describes some embodiments of the invention with reference to the drawings. The following description only illustrates an aspect of the invention, and changes can be made within the scope of the aspect of the invention. In the drawings, like elements are referenced by like numerals so that duplicate descriptions can be avoided. The letters X, Y, and Z in the drawings refer to three spatial axes perpendicular to one another. The directions along these axes are herein referred to as directions X, Y, and Z. Direction Z is the direction of the thickness of plates, layers, and films or the direction in which they are stacked. Directions X and Y are in-plane directions based on plates, layers, and films.

Embodiment 1

Figure 2:
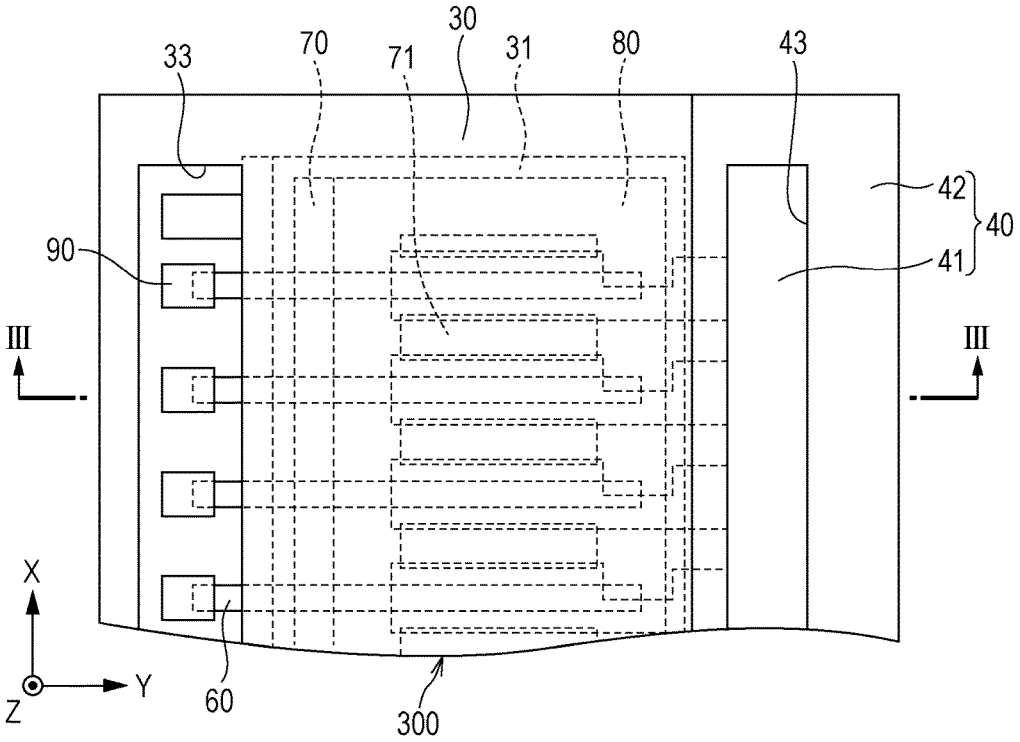
FIG. 2 is a plan view of a recording head according to Embodiment 1 of the invention.
Figure 3:
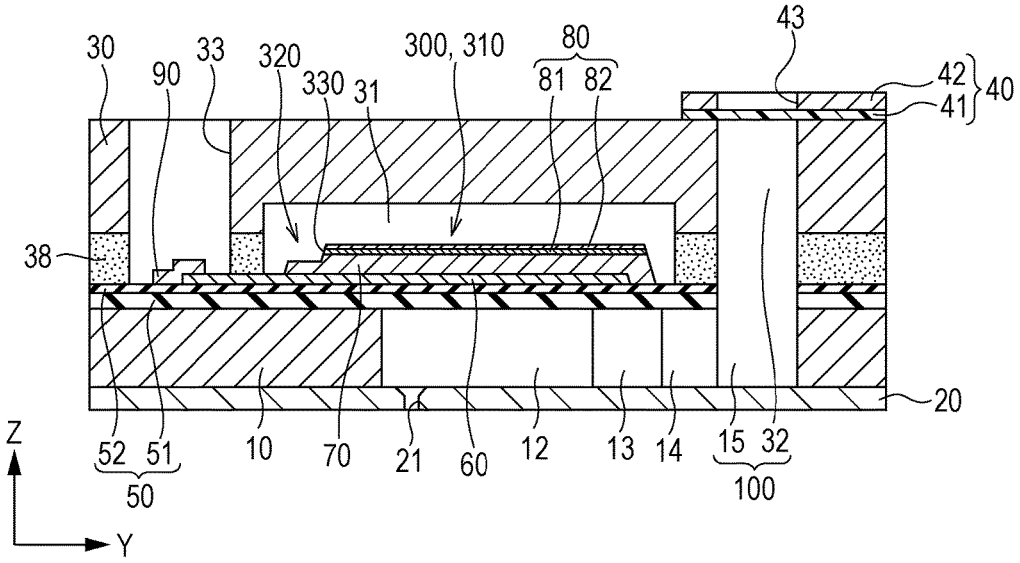
FIG. 3 is a cross-sectional view of a recording head according to Embodiment 1 of the invention.
Figure 4:
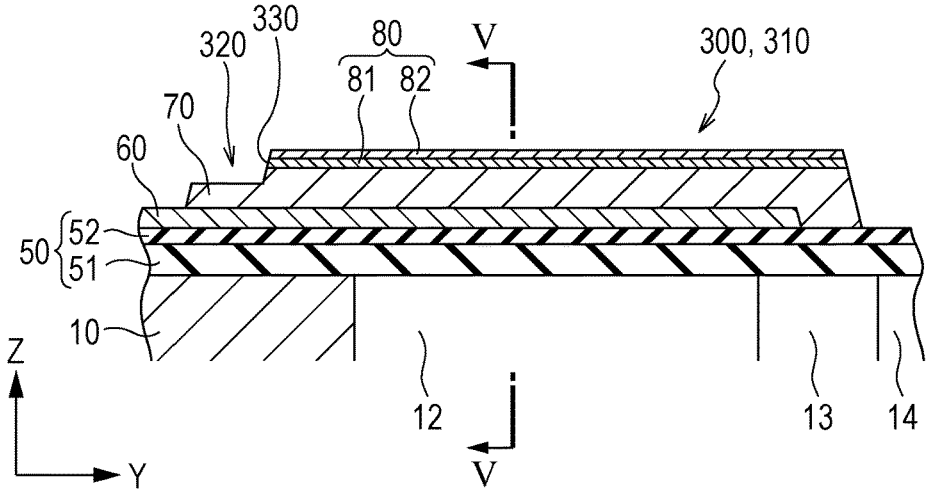
FIG. 4 is an enlarged cross-sectional view of some essential components of a recording head according to Embodiment 1 of the invention.
Figure 5:
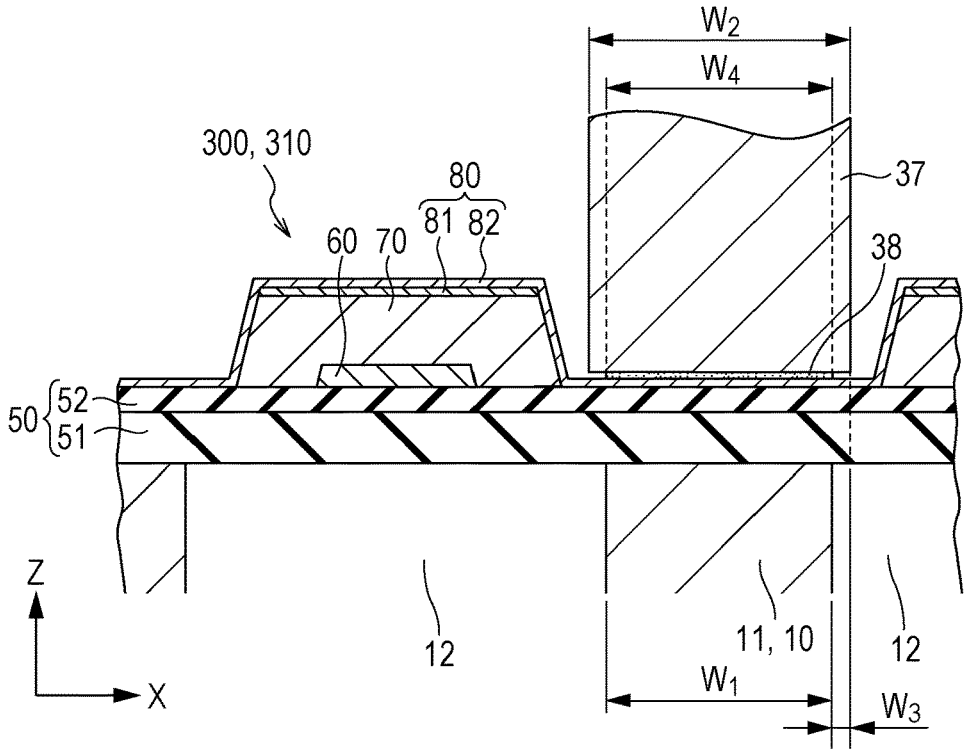
FIG. 5 is an enlarged cross-sectional view of some essential components of a recording head according to Embodiment 1 of the invention.

FIG. 1 is a perspective view of an ink jet recording head as an example of a liquid ejecting head according to Embodiment 1 of the invention. FIGS. 2 and 3 are a plan view and a cross-sectional view, respectively, of the ink jet recording head. FIGS. 4 and 5 are enlarged cross-sectional diagrams from FIG. 3, illustrating some essential components.

As illustrated, a flow channel substrate 10 as a component of an ink jet recording head I, an example of a liquid ejecting head according to this embodiment, has pressure chambers 12. The pressure chambers 12, defined by multiple walls 11, are lined up in the direction in which multiple nozzle openings 21 for ejecting ink of the same color are lined up. This direction is hereinafter referred to as the direction of arrangement of the pressure chambers 12 or the first direction X. The direction perpendicular to the first direction X is hereinafter referred to as the second direction Y.

At the side of the longitudinal ends, on one side, of the pressure chambers 12 in the flow channel substrate 10, or at the side of the ends on one side in the second direction Y, perpendicular to the first direction X, ink supply paths 13 and communicating paths 14 are defined by the walls 11. Outside the communicating paths 14 (opposite the pressure chambers 12 in the second direction Y) is a communicating space 15, a component of a manifold 100 that provides a common ink tank (liquid tank) for the pressure chambers 12. The flow channel substrate 10 therefore has a liquid-flow channel formed by the pressure chambers 12, ink supply paths 13, communicating paths 14, and communicating space 15.

On the side of the flow channel substrate 10 on which the liquid-flow channel formed by the pressure chambers 12, etc., has openings, there is a nozzle plate 20 joined to the flow channel substrate 10 with an adhesive agent, hot-melt film, or any similar substance. The nozzle plate 20 has nozzle openings 21 created therethrough communicating with the pressure chambers 12. In other words, the nozzle plate 20 has nozzle openings 21 lined up in the first direction X.

On the other side of the flow channel substrate 10 is a diaphragm 50. The diaphragm 50 according to this embodiment is composed of an elastic film 51 on the flow channel substrate 10 and an insulating film 52 on the elastic film 51. The liquid-flow channel formed by the pressure chambers 12, etc., is created by anisotropically etching the flow channel substrate 10 from one side, and the other side of the liquid-flow channel formed by the pressure chambers 12, etc., is the diaphragm 50 (elastic film 51).

On the insulating film 52 are piezoelectric elements 300 each composed of a first electrode 60, which is about 0.2 μm thick for example, a piezoelectric layer 70, about 1.0 μm thick for example, and a second electrode 80, about 0.05 μm thick for example. These piezoelectric elements 300 provided on the substrate (flow channel substrate 10) serve an actuator in this embodiment.

The following further details the piezoelectric elements 300, which compose an actuator, with reference to FIG. 3.

As illustrated in FIG. 3, the first electrode 60, a component of the piezoelectric elements 300, is divided into multiple sections corresponding to the pressure chambers 12, providing separate electrodes each independently corresponding to a piezoelectric element 300. The first electrode 60 is narrower than the pressure chambers 12 in the first direction X of the pressure chambers 12. In other words, in the first direction X of the pressure chambers 12, the ends of the first electrode 60 are inside the regions facing the pressure chambers 12. In the second direction Y of the pressure chambers 12, both ends of the first electrode 60 are outside the edges of the pressure chambers 12. The first electrode 60 can be made of any metallic material but is preferably made of, for example, platinum (Pt) or iridium (Ir).

The piezoelectric layer 70 is continuous in the first direction X and has a predetermined width in the second direction Y. The width of the piezoelectric layer 70, in the second direction Y, is larger than the length of the pressure chambers 12 in the second direction Y. As a result, in the second direction Y of the pressure chambers 12, the piezoelectric layer 70 extends beyond the edges of the pressure chambers 12.

On one side in the second direction Y of the pressure chambers 12 (in this embodiment, on the ink supply path side), the end of the piezoelectric layer 70 is beyond the edge of the first electrode 60. That is, the ends of the first electrode 60 are covered with the piezoelectric layer 70. On the other side in the second direction Y of the pressure chambers 12, the end of the piezoelectric layer 70 is inside the edge of the first electrode 60 (i.e., closer to the pressure chambers 12).

To the side of the first electrode 60 extending beyond the edge of the piezoelectric layer 70 is connected lead electrodes 90 made of, for example, gold (Au). Although not illustrated, these lead electrodes 90 provide terminals to which wiring leading to a driver and other components is connected.

The piezoelectric layer 70 also has depressions 71 facing the walls 11. The width of the depressions 71, in the first direction X, is substantially equal to or larger than the width of the walls 11, in the first direction X. In this embodiment, it is larger than the width of the walls 11, in the first direction X. This makes the diaphragm 50 exposed in the portions facing the lateral ends of the pressure chambers 12 (the "arms" of the diaphragm 50), ensuring good displacement of the piezoelectric elements 300.

An example of the piezoelectric layer 70 is a perovskite-structured crystal film (perovskite crystals) formed on the first electrode 60 and made of a ferroelectric ceramic material capable of electrochemical conversion. Examples of materials for the piezoelectric layer 70 include ferroelectric piezoelectric materials, such as lead zirconate titanate (PZT), and their derivatives doped with a metal oxide, such as those doped with niobium oxide, nickel oxide, or magnesium oxide. Specific examples include lead titanate ($PbTiO_3$), lead zirconate titanate ($Pb(Zr, Ti)O_3$), lead zirconate ($PbZrO_3$), lead lanthanum zirconate ($(Pb, La)TiO_3$), lead lanthanum zirconate titanate ($(Pb, La)(Zr, Ti)O_3$), and lead zirconium titanate magnesium niobate ($Pb(Zr, Ti)(Mg, Nb)O_3$). In this embodiment, the piezoelectric layer 70 is a layer of lead zirconate titanate (PZT).

The materials for the piezoelectric layer 70 are not limited to lead-based piezoelectric materials, which contain lead, and include lead-free piezoelectric materials, which contain no lead. Examples of lead-free piezoelectric materials include bismuth ferrite ($BiFeO_3$, abbreviated to BFO), barium titanate ($BaTiO_3$, BT), sodium potassium niobate ($(K, Na)NbO_3$, KNN), potassium sodium lithium niobate ($(K, Na, Li)NbO_3$), potassium sodium lithium niobate tantalate ($(K, Na, Li)(Nb, Ta)O_3$), bismuth potassium titanate ($(Bi_{1/2}K_{1/2})TiO_3$, BKT), bismuth sodium titanate ($(Bi_{1/2}Na_{1/2})TiO_3$, BNT), and bismuth manganite ($BiMnO_3$, BM); perovskite composite oxides containing bismuth, potassium, titanium, and iron ($x[(Bi_xK_{1-x})TiO_3]$-$(1-x)[BiFeO_3]$, BKT-BF); and perovskite composite oxides containing bismuth, iron, barium, and titanium ($(1-x)[BiFeO_3]$-$x[BaTiO_3]$, BFO-BT) and their metal-doped derivatives, such as those doped with manganese, cobalt, or chromium ($(1-x)[Bi(Fe_{1-y}M_y)O_3]$-$x[BaTiO_3]$; M, Mn, Co, or Cr).

As further detailed hereinafter, the piezoelectric layer 70 can be formed by a liquid-phase process, such as the sol-gel process or MOD (metal-organic decomposition), a PVD (physical vapor deposition) process (gas-phase process), such as sputtering or laser abrasion, or any other method. In this embodiment, the internal stress in the piezoelectric layer 70 upon formation is tensile stress.

The second electrode 80 is continuous in the first direction X of the pressure chambers 12 on the piezoelectric layer 70 and provides a common electrode for the multiple piezoelectric elements 300. In this embodiment, the second electrode 80 includes a first layer 81 on the piezoelectric layer 70 side and a second layer 82 on the side of the first layer 81 opposite the piezoelectric layer 70. Incidentally, the first layer 81 is, for example, produced by forming an iridium layer, which is a layer of iridium, on the piezoelectric layer 70, forming a titanium layer, which is a layer of titanium, on the iridium layer, and then oxidizing these layers by heating them (further detailed hereinafter) and therefore contains iridium oxide and titanium oxide. The iridium layer in the first layer 81, incidentally, serves as a diffusion-blocking layer that prevents excessive diffusion of the ingredients of the piezoelectric layer 70 into the first layer 81 during the heating process while preventing the diffusion of the ingredient of the titanium layer into the piezoelectric layer 70.

The titanium layer in the first layer 81 catches excessive amounts of the ingredients of the piezoelectric layer 70 from the surface (on the second electrode 80 side) of the piezoelectric layer 70, e.g., excess lead on the surface of the piezoelectric layer 70 if a lead-containing piezoelectric layer 70 is used, improving the piezoelectric properties of the piezoelectric layer 70.

The second layer 82 of the second electrode 80 is made of electroconductive material(s). For example, it can be a layer of iridium or a stack of layers of titanium and iridium. The second layer 82 is thicker than the first layer 81 so that it has a low electric resistance. Since the internal stress in the iridium layer is compressive and that in the titanium layer is substantially zero, the internal stress in the second electrode 80 is compressive.

On one side in the second direction Y of the pressure chambers 12 (the ink supply path side), the end of the second electrode 80 is inside the edge of the piezoelectric layer 70 (i.e., closer to the pressure chambers 12). That is, one end of the piezoelectric layer 70 in the second direction Y is sticking out beyond the edge of the second electrode 80.

Configured as such, the piezoelectric elements 300 are displaced when voltage is applied across the first electrode 60 and the second electrode 80. More specifically, applying voltage across the two electrodes induces piezoelectric strain in the portions of the piezoelectric layer 70 sandwiched between the first electrode 60 and the second electrode 80. The portions of the piezoelectric layer 70 in which piezoelectric strain occurs upon application of voltage across the two electrodes are referred to as active portions 310. The portions of the piezoelectric layer 70 in which no piezoelectric strain occurs are referred to as inactive portions 320. The active portions 310, the portions of the piezoelectric layer 70 in which piezoelectric strain occurs, each have an area that faces a pressure chamber 12, which is referred to as flexible area. The area of an active portion 310 that lies outside the edge of the pressure chamber 12 is referred to as inflexible area.

In this embodiment, the first electrode 60, piezoelectric layer 70, and second electrode 80 all continue beyond the edges of the pressure chambers 12 in the second direction Y of the pressure chambers 12. The active portions 310 therefore continue beyond the edges of the pressure chambers 12. As a result, the area of each active portion 310 in which the piezoelectric element 300 faces a pressure chamber 12 is flexible, and the area that lies outside the edges of the pressure chambers 12 is inflexible.

In this embodiment, as illustrated in FIG. 4, the ends of each active portion 310 in the second direction Y are defined by the second electrode 80 and are positioned outside the region facing the pressure chamber 12, or in the inflexible area.

Outside the active portion 310 in the second direction Y, on the side opposite the ink supply path in this embodiment, is an inactive portion 320, to which the second electrode 80 does not extend. In the second direction Y, the inactive portion 320 is thinner than the active portion 310. That is, there is a difference in height between the active portion 310 and inactive portion 320 because of the difference in thickness. The different levels are connected by a slope 330, a surface sloping with respect to the direction perpendicular to the surface of the flow channel substrate 10 on which the piezoelectric elements 300 are provided (the normal direction). The thickness of the active portion 310 and that of the inactive portion 320 are the thickness of the piezoelectric layer 70 and the thickness of the first electrode 60, piezoelectric layer 70, and second electrode 80 in the direction of stacking.

Such a slope 330 between the active portion 310 and the inactive portion 320 is preferably formed at an angle of 10 to 45 degrees with respect to the surface of the active portion 310. This is because, for example, increasing the angle of the slope 330 beyond 45 degrees and to near the vertical would cause stress to be concentrated at the corner between the slope 330 and the inactive portion 320, resulting in a crack or any other type of fracture occurring in the corner between the slope 330 and the inactive portion 320.

The end of the active portion 310 on the ink supply path 13 side in the second direction Y is positioned above the opening formed by the ink supply path 13, communicating path 14, etc. At the end of the active portion 310 on the ink supply path 13 side in the second direction Y, therefore, the stress at the boundary between the active portion 310 and the inactive portion 320 is released through the deformation of the diaphragm 50, and it is unlikely that the piezoelectric layer 70 fractures, for example by burning out or cracking, despite the lack of a feature like the slope 330 at the end of the active portion 310 on the ink supply path 13 side in the second direction Y. Naturally, forming an inactive portion 320 and a slope 330 at the end of the active portion 310 on the ink supply path 13 side in the second direction Y, too, would reliably prevent burnouts, cracks, and other fractures associated with stress concentration at the end of the active portion 310 on the ink supply path 13 side in the second direction Y.

The ends of the active portion 310 in the first direction X are defined by the ends of the first electrode 60 in the first direction X, and the ends of the first electrode 60 in the first direction X are inside the region facing the pressure chamber 12. The ends of the active portion 310 in the first direction X are therefore located in the flexible area, and the stress that occurs at the boundary between the active portion 310 and the inactive portion 320 in the first direction X is released through the deformation of the diaphragm 50. In this embodiment, therefore, there is no need to provide a slope 330 at the ends of the active portion 310 of the piezoelectric layer 70 in the first direction X.

On the flow channel substrate 10 with such piezoelectric elements 300 thereon, as illustrated in FIGS. 1 to 3, there is a protective substrate 30, for protecting the piezoelectric elements 300, joined thereto with an adhesive agent 38. The protective substrate 30 has a piezoelectric element housing 31, a recess that defines the space in which the piezoelectric elements 300 are housed. The protective substrate 30 also has a manifold portion 32 as a component of the manifold 100. The manifold portion 32 extends through the entire thickness of the protective substrate 30 and along the direction of the width of the pressure chambers 12 and, as mentioned above, communicates with the communicating space 15 of the flow channel substrate 10. The protective substrate 30 also has a through-hole 33 created through the entire thickness of the protective substrate 30. The lead electrodes 90, each coupled to the first electrode 60 in each active portion 310, are exposed in this through-hole 33, and one end of wiring to be connected to a not-illustrated driver is coupled to the lead electrodes 90 in this through-hole 33.

At the positions inside the piezoelectric element housing 31 where the protective substrate 30 faces the walls 11 are holding members 37, for holding the diaphragm 50 on the walls 11, formed integrally with the protective substrate 30. The holding members 37, specifically, are provided at the positions where the protective substrate 30 faces the walls 11 and the depressions 71 in the piezoelectric layer 70 are located, and the interface, at the distal end, of each holding member 37 is joined to the second electrode 80 with the adhesive agent 38. The width $W_2$ of the holding members 37, the dimension measured in the first direction X, is slightly larger than the width $W_1$ of the walls 11.

The dimension of the holding members 37 in the second direction Y is set according to the length of the depressions 71, in the second direction Y, preferably to be equivalent to or greater than the length of the pressure chambers 12. It should be noted that the length of the holding members 37 may be smaller than that of the pressure chambers 12, because near the ends of the pressure chambers 12 in the second direction Y, the maximum stress at the ends in the first direction X, described hereinafter, is small compared with that near the middle in the second direction Y. The holding members 37 only need to be provided in the middle of the pressure chambers 12 in the second direction Y over a dimension at least half, preferably 70% or more of, the length of the pressure chambers 12.

Providing such holding members 37 will reduce, as demonstrated in Examples below, the maximum stress that occurs in the diaphragm 50 when the piezoelectric elements 300 are driven, and, furthermore, move stress raisers to right under the lateral ends of the holding members 37. If there were no holding members 37, stress raisers would be present on the wall 11 side with respect to the corners formed between the pressure chambers 12 and the walls 11, making cracks running from the corners toward the wall 11 side more likely. Providing the holding members 37 will reduce the maximum stress, move stress raisers to the regions facing the pressure chambers 12, and, therefore, prevent cracks.

Given such an effect, the width $W_2$ of the holding members 37 is at least equal to, preferably greater than, the width $W_1$ of the walls 11. Since interference with the piezoelectric elements 300 would obstruct their displacement, the upper limit is the width with which the holding members 37 do not interfere with the piezoelectric elements 300. Specifically, it is determined by what length the width of the arms, the areas of the diaphragm 50 extending alongside the piezoelectric elements 300, is set to. The width $W_3$ of the regions of the holding members 37 sticking out beyond the edges of the walls 11 is 0.5 times the width $W_1$ of the walls 11 or less, preferably 0.3 times $W_1$ or less, more preferably 0.2 times $W_1$ or less. This is mathematically expressed as follows:

$$0 \leq W_3 \leq 0.5W_1 \text{ (or } 0.3W_1 \text{ or } 0.2W_1\text{)}$$

As stated, it is preferred that the lateral ends (ends in the first direction X) of the holding members 37 stick out to the regions facing the pressure chambers 12 rather than the holding members 37 have the same width as the walls 11. For the adhesive agent 38, provided in the regions where the holding members 37 are joined to the diaphragm 50, however, it is preferred that it do not stick out beyond the edges of the walls 11 to the regions facing the pressure chambers 12 or be inside the edges of the walls 11, since this prevents displacement obstruction. In this embodiment, the width $W_4$ of the adhesive agent 38 is set to be equivalent to or smaller than the width $W_1$ of the walls 11.

In this embodiment, the protective substrate 30 is a silicon substrate, and the holding members 37 are integral with it. The holding members 37, however, may be separate from the protective substrate 30. In a configuration in which no protective substrate 30 is provided, it is possible to provide the holding members 37 alone.

If the holding members 37 are provided alone or are separate from the protective substrate 30, it is possible to connect multiple holding members 37 into a single structure instead of providing one for each wall 11. Furthermore, silicon is not the only material of choice for the holding members 37. For example, the holding members 37 can be a glass or high-definition resist pattern.

On the protective substrate 30 is a compliance substrate 40 joined thereto, the compliance substrate 40 composed of a sealing film 41 and a stationary plate 42. The sealing film 41 is a film of a low-rigidity flexible material, and this sealing film 41 seals one side of the manifold portion 32. The stationary plate 42 is formed from a hard material, such as metal. The region of the stationary plate 42 facing the manifold 100 is an opening 43 created through the entire thickness. Thus, one side of the manifold 100 is sealed with the flexible sealing film 41 alone.

Such an ink jet recording head I according to this embodiment takes in ink from a not-illustrated external ink source via an ink inlet connected to the ink source, fills the entire space from the manifold 100 to the nozzle openings 21 with the ink, and then, in response to recording signals from a driver, applies voltage across the first electrode 60, or each of its segments corresponding to the pressure chambers 12, and the second electrode 80. The piezoelectric elements 300 and the diaphragm 50 undergo flexural deformation, pressurizing the pressure chambers 12. As a result, ink droplets are ejected through the nozzle openings 21.

The following describes a method for producing such an ink jet recording head according to this embodiment. FIGS. 6 to 21 are cross-sectional diagrams illustrating a method for producing an ink jet recording head.

Figure 6:
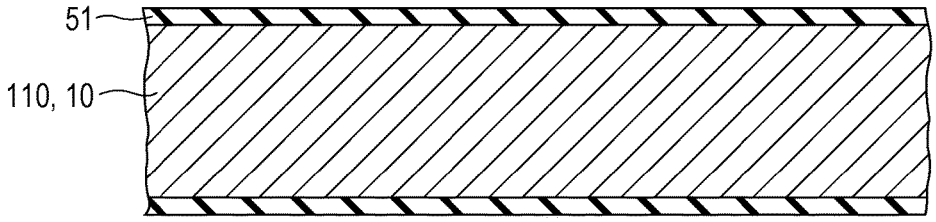
FIG. 6 is a cross-sectional diagram illustrating a method for producing a recording head according to Embodiment 1 of the invention.

First, as illustrated in FIG. 6, an elastic film 51 is formed on the surface of a silicon flow channel substrate wafer 110. In this embodiment, a silicon-dioxide elastic film 51 is formed by thermally oxidizing the flow channel substrate wafer 110. Naturally, silicon dioxide is not the only material of choice and the elastic film 51 can be a film of, for example, silicon nitride, polycrystalline silicon, or an organic compound (e.g., polyimide or Parylene). Likewise, thermal oxidation is not the only formation process of choice and the elastic film 51 can be formed by, for example, sputtering, CVD, or spin coating.

Figure 7:
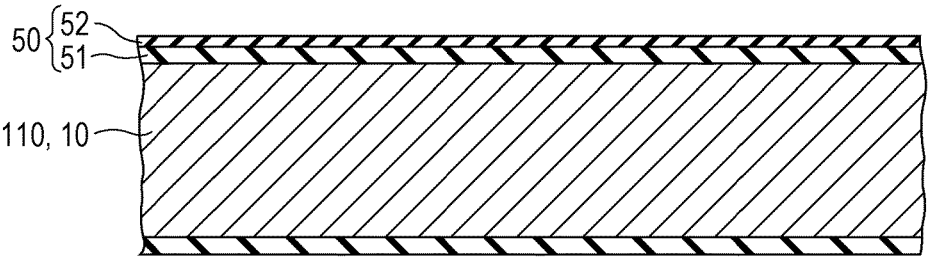
FIG. 7 is a cross-sectional diagram illustrating a method for producing a recording head according to Embodiment 1 of the invention.

Then, as illustrated in FIG. 7, a zirconium-oxide insulating film 52 is formed on the elastic film 51. Naturally, zirconium oxide is not the only material of choice and the insulating film 52 can be made of, for example, titanium oxide ($TiO_2$), aluminum oxide ($Al_2O_3$), hafnium oxide ($HfO_2$), magnesium oxide (MgO), or lanthanum aluminate ($LaAlO_3$). Examples of processes for the formation of the insulating film 52 include sputtering, CVD, and vapor deposition. In this embodiment, the elastic film 51 and the insulating film 52 form a diaphragm 50. The diaphragm 50, however, can alternatively be the elastic film 51 or insulating film 52 provided alone.

Figure 8:
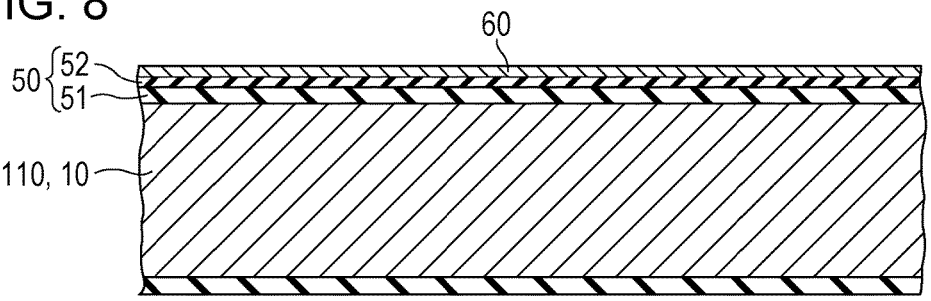
FIG. 8 is a cross-sectional diagram illustrating a method for producing a recording head according to Embodiment 1 of the invention.

Then, as illustrated in FIG. 8, a first electrode 60 is formed over the entire surface of the insulating film 52. The first electrode 60 can be made of any material, but if the manufacturer plans to use lead zirconate titanate (PZT) for the piezoelectric layer 70, materials unlikely to vary in conductivity upon diffusion of lead oxide are desirable. Thus, examples of suitable materials for the first electrode 60 include platinum and iridium. The first electrode 60 can be formed by, for example, sputtering or PVD (physical vapor deposition).

Figure 9:
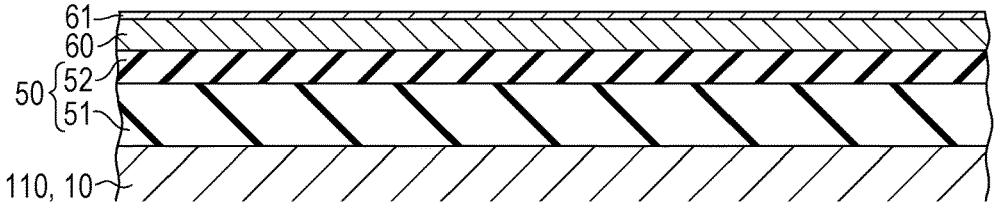
FIG. 9 is a cross-sectional diagram illustrating a method for producing a recording head according to Embodiment 1 of the invention.

Then, as illustrated in FIG. 9, a titanium (Ti) seed crystal layer 61 is formed on the first electrode 60. Providing a seed crystal layer 61 on the first electrode 60 in this way will make the piezoelectric layer 70, which is formed later on the first electrode 60 with the seed crystal layer 61 therebetween, suitable for use as an electromechanical transducer because the seed crystal layer 61 will control the preferred orientation of the piezoelectric layer 70 to (100). The seed crystal layer 61 provides seeds for the crystallization of the piezoelectric layer 70 and then, after the piezoelectric layer 70 is fired, diffuses into the piezoelectric layer 70. Although in this embodiment the seed crystal layer 61 is a layer of titanium (Ti), the seed crystal layer 61 can be made of any material that provides cores for the piezoelectric layer 70 to grow from during the formation of the piezoelectric layer 70.

For example, the seed crystal layer 61 can be a layer of titanium oxide ($TiO_2$). Materials other than titanium or titanium oxide, such as lanthanum nickel oxide (LNO), can also be used. Naturally, the seed crystal layer 61 may be left between the first electrode 60 and the piezoelectric layer 70. The seed crystal layer 61 may be in the layer or islands structure.

Then, in this embodiment, a lead zirconate titanate (PZT) piezoelectric layer 70 is formed. In this embodiment, the piezoelectric layer 70 is formed using the "sol-gel process," in which a solution/dispersion, or a "sol," of a metal complex in a solvent is applied and dried into gel, and the gel is fired at high temperatures to give a metal-oxide piezoelectric layer 70. The sol-gel process is not the only process of choice and the piezoelectric layer 70 can be produced by, for example, MOD (metal-organic decomposition) or a PVD (physical vapor deposition) process, such as sputtering or laser abrasion. That is, both liquid-phase and gas-phase processes can be used to form the piezoelectric layer 70.

Figure 10:
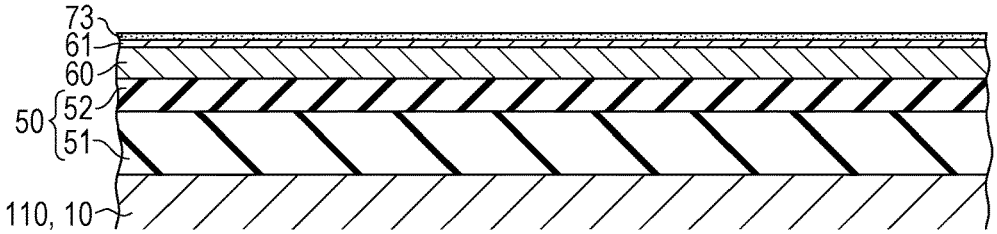
FIG. 10 is a cross-sectional diagram illustrating a method for producing a recording head according to Embodiment 1 of the invention.

The following describes a specific example of a procedure for the formation of the piezoelectric layer 70. First, as illustrated in FIG. 10, a precursor piezoelectric film 73, which is a film of a precursor material to PZT, is formed on the seed crystal layer 61. Specifically, a sol (or solution) containing a metal complex is applied to the flow channel substrate wafer 110 with the first electrode 60 (and the seed crystal layer 61) thereon (application), and this precursor piezoelectric film 73 is heated to a predetermined temperature and dried for a certain period of time (drying). In this embodiment, the precursor piezoelectric film 73 can be dried by holding it at a temperature of 170° C. to 180° C. for 8 to 30 minutes, for example.

Then, the dried precursor piezoelectric film 73 is degreased by heating the dried film to a predetermined temperature and keeping it at that temperature for a certain period of time (degreasing). In this embodiment, the dried precursor piezoelectric film 73 can be degreased by heating the dried film to a temperature of roughly 300° C. to 400° C. and keeping it at that temperature for approximately 10 to 30 minutes, for example. The term degreasing, as used herein, refers to removing organic components of the precursor piezoelectric film 73 in the form of, for example, $NO_2$, $CO_2$, and $H_2O$.

Figure 11:
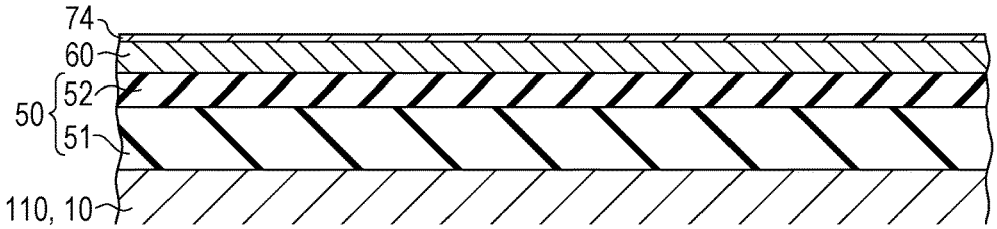
FIG. 11 is a cross-sectional diagram illustrating a method for producing a recording head according to Embodiment 1 of the invention.

Then, as illustrated in FIG. 11, the degreased precursor piezoelectric film 73 is heated to a predetermined temperature and kept at that temperature for a certain period of time, crystallizing into a piezoelectric film 74 (firing). It is preferred that the degreased precursor piezoelectric film 73 be heated to a temperature of 700° C. or more, and that the rate of temperature elevation be 50° C./sec or more. This gives the piezoelectric film 74 superior characteristics.

The seed crystal layer 61, formed on the first electrode 60, diffuses into the piezoelectric film 74. Naturally, the seed crystal layer 61 may be left between the first electrode 60 and the piezoelectric film 74, whether as a titanium or titanium oxide layer.

Examples of heaters for such drying, degreasing, and firing include a hot plate and RTP (rapid thermal processing) systems, which provide heating through irradiation with an infrared lamp.

Figure 12:
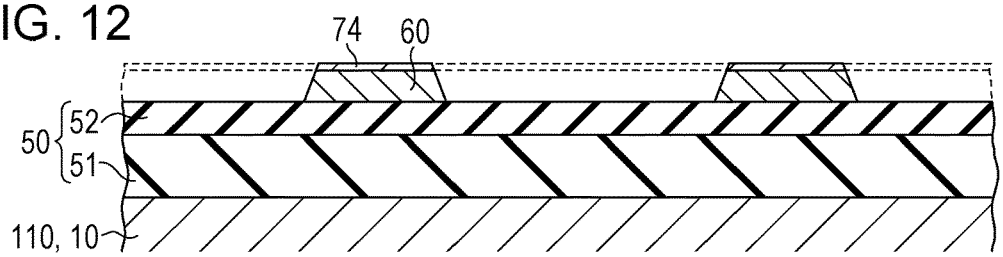
FIG. 12 is a cross-sectional diagram illustrating a method for producing a recording head according to Embodiment 1 of the invention.

Then, after the formation of the first piezoelectric film 74 on the first electrode 60, the first electrode 60 and the first piezoelectric film 74 are simultaneously patterned to have sloping sides as illustrated in FIG. 12. The patterning of the first electrode 60 and the first piezoelectric film 74 can be done by, for example, a dry etching process, such as ion milling.

If, for example, the first electrode 60 were patterned before the formation of the first piezoelectric film 74, the surface of the first electrode 60 and other components on it, such as a not-illustrated seed crystal layer, for example a layer of titanium, would deteriorate because the patterning of the first electrode 60 would involve photographic operations, ion milling, and ashing. Forming the piezoelectric film 74 on such an altered surface would result in insufficient crystallinity of the piezoelectric film 74. Since the crystallinity of the first piezoelectric film 74 influences the crystal growth in the second and subsequent piezoelectric films 74, the resulting piezoelectric layer 70 would be insufficient in terms of crystallinity.

In contrast, the approach of forming the first piezoelectric film 74 first and then patterning it simultaneously with the first electrode 60 does not greatly affect the crystal growth in the second and subsequent piezoelectric films 74, even if the patterning produces a thin altered layer on the top surface. This is because the first piezoelectric film 74, as compared with titanium or similar seed crystals, is apt to behave as seeds for crystals to grow well in the second and subsequent piezoelectric films 74.

Figure 13:
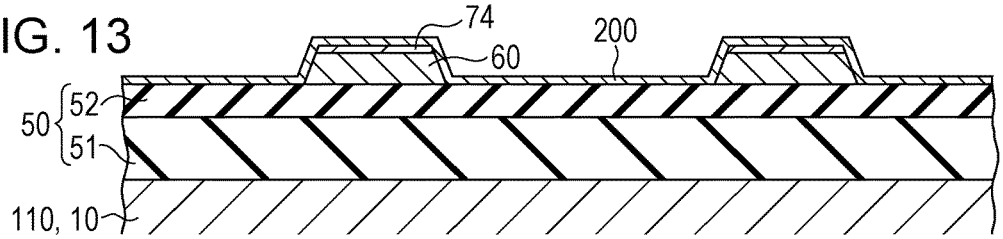
FIG. 13 is a cross-sectional diagram illustrating a method for producing a recording head according to Embodiment 1 of the invention.

Then, after the patterning of the first piezoelectric film 74 and the first electrode 60, an intermediate seed crystal layer 200 is formed over the surface of the insulating film 52, the sides of the first electrode 60, the sides of the first piezoelectric film 74, and the top of the first piezoelectric film 74 as illustrated in FIG. 13. Examples of materials for the intermediate seed crystal layer 200 are similar to those for the seed crystal layer 61: titanium, lanthanum nickel oxide, and so forth. Like the seed crystal layer 61, the intermediate seed crystal layer 200 may be in the layer or islands structure.

Figure 14:
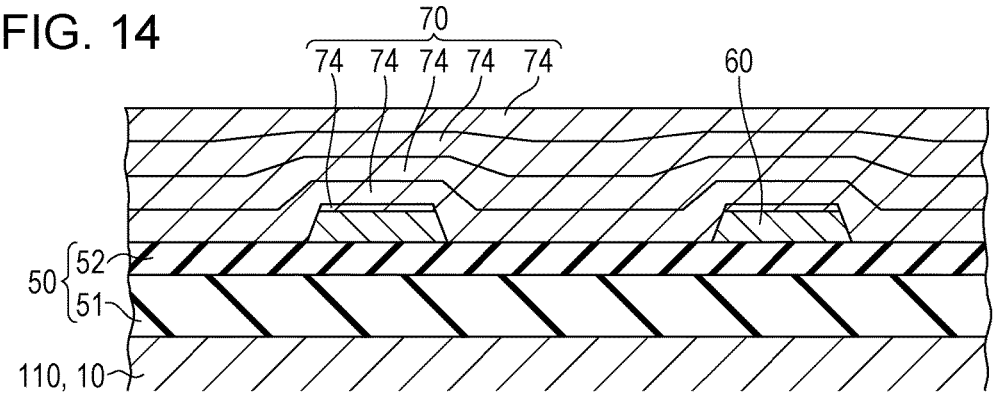
FIG. 14 is a cross-sectional diagram illustrating a method for producing a recording head according to Embodiment 1 of the invention.

Then, as illustrated in FIG. 14, a piezoelectric layer 70 composed of multiple piezoelectric films 74 is formed by repeating multiple times the formation of a piezoelectric film, that is, the application, drying, degreasing, and firing described above.

Incidentally, the second and subsequent piezoelectric films 74 are formed continuously over the surface of the insulating film 52, the sides of the first electrode 60 and the first piezoelectric film 74, and the top of the first piezoelectric film 74. Since these regions on which the second and subsequent piezoelectric films 74 are formed have been coated with the intermediate seed crystal layer 200, the preferred orientation of the second and subsequent piezoelectric films 74 is controlled to (100) by the intermediate seed crystal layer 200, and crystal grains in the resulting films are very small in diameter. It should be understood that the intermediate seed crystal layer 200 provides seeds for the crystallization of the piezoelectric layer 70 and then, after the piezoelectric layer 70 is fired, diffuses into the piezoelectric layer 70 completely. Alternatively, part of it may be left in an unchanged or oxidized form.

Figure 15:
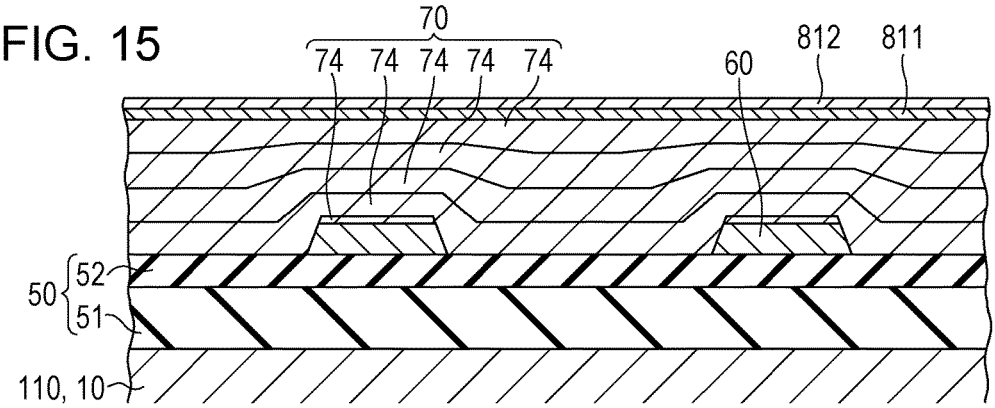
FIG. 15 is a cross-sectional diagram illustrating a method for producing a recording head according to Embodiment 1 of the invention.

Then, as illustrated in FIG. 15, an iridium layer 811, which contains iridium, is formed on the piezoelectric layer 70, and a titanium layer 812, which contains titanium, is formed on the iridium layer 811. The iridium layer 811 and the titanium layer 812 can be formed by, for example, sputtering or CVD.

Figure 16:
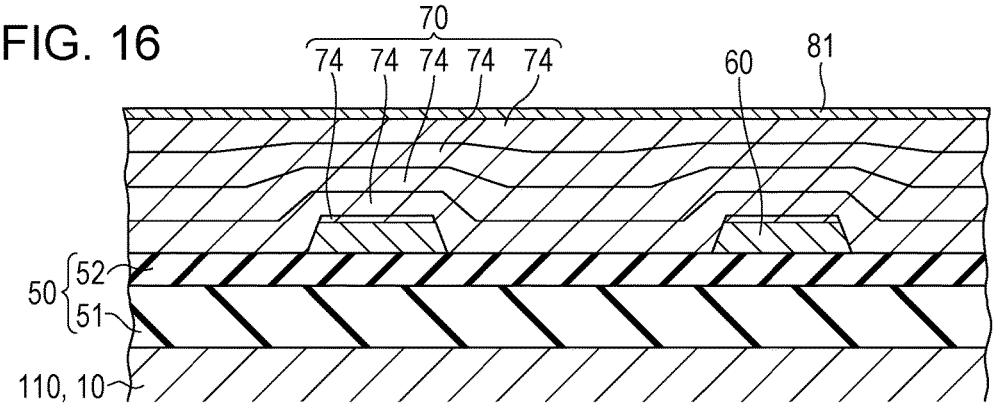
FIG. 16 is a cross-sectional diagram illustrating a method for producing a recording head according to Embodiment 1 of the invention.

Then, as illustrated in FIG. 16, the piezoelectric layer 70 with the iridium layer 811 and the titanium layer 812 thereon is heated once again (post-annealing). Even if the formation of layers such as the iridium layer 811 on the second electrode 80 side of the piezoelectric layer 70 causes damage, the post-annealing repairs the damage to the piezoelectric layer 70 and improves the piezoelectric properties of the piezoelectric layer 70. Furthermore, when a lead-containing piezoelectric layer 70 is used as in this embodiment, the post-annealing makes an excess of lead on the second electrode 80 side of the piezoelectric layer 70 adsorbed onto the iridium layer 811 and the titanium layer 812, preventing the piezoelectric properties of the piezoelectric layer 70 from being affected by the excess lead.

Furthermore, the iridium layer 811 and the titanium layer 812 form a first layer 81 containing iridium oxide and titanium oxide through the post-annealing. Incidentally, as mentioned above, there may be adsorbed excess lead on the first layer 81.

The post-annealing temperature is preferably between −10° C. and +50° C. from the temperature for the firing for the formation of the piezoelectric films 74 (the temperature at which the precursor piezoelectric coatings 73 are heated and crystallized).

Figure 17:
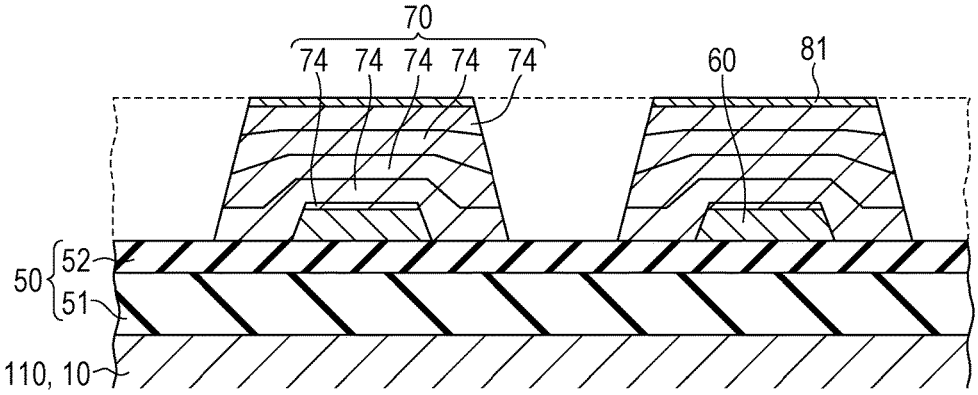
FIG. 17 is a cross-sectional diagram illustrating a method for producing a recording head according to Embodiment 1 of the invention.

Then, as illustrated in FIG. 17, the first layer 81 and the piezoelectric layer 70 are patterned, leaving the areas beneath which pressure chambers 12 are to be created. In this embodiment, these layers are patterned by "photolithography," in which the piezoelectric layer 70 is etched with a mask prepared in a predetermined shape (not illustrated) on the first layer 81. Examples of processes for the patterning of the piezoelectric layer 70 include dry etching processes, such as reactive ion etching and ion milling.

Figure 18:
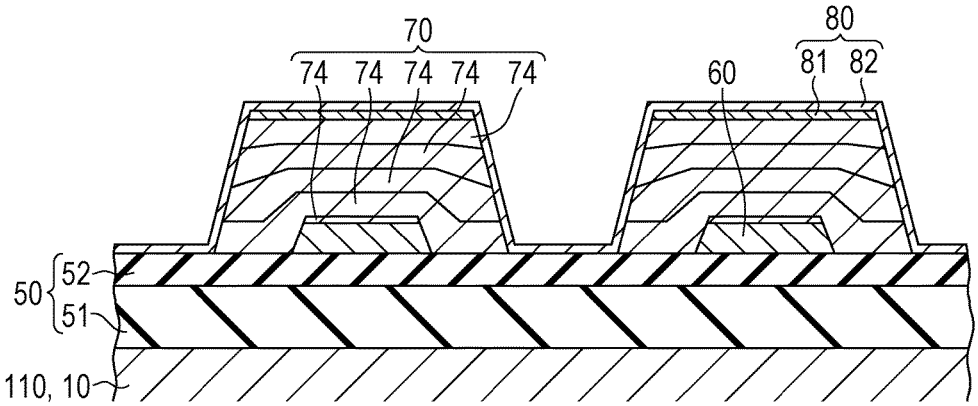
FIG. 18 is a cross-sectional diagram illustrating a method for producing a recording head according to Embodiment 1 of the invention.

Then, as illustrated in FIG. 18, a second electrode 80 is formed by producing a second layer 82, for example a layer of iridium (Ir), over the surfaces of the first layer 81, the sides of the patterned piezoelectric layer 70, and the surfaces of the insulating film 52, and the second electrode 80 is patterned into a predetermined shape. This forms active portions 310 and inactive portions 320 and, by overetching part of the piezoelectric layer 70 in the direction of thickness, creates slopes 330 (see FIG. 4).

Then, although not illustrated, lead electrodes 90 are formed and patterned into a predetermined shape (see FIG. 2).

Figure 19:
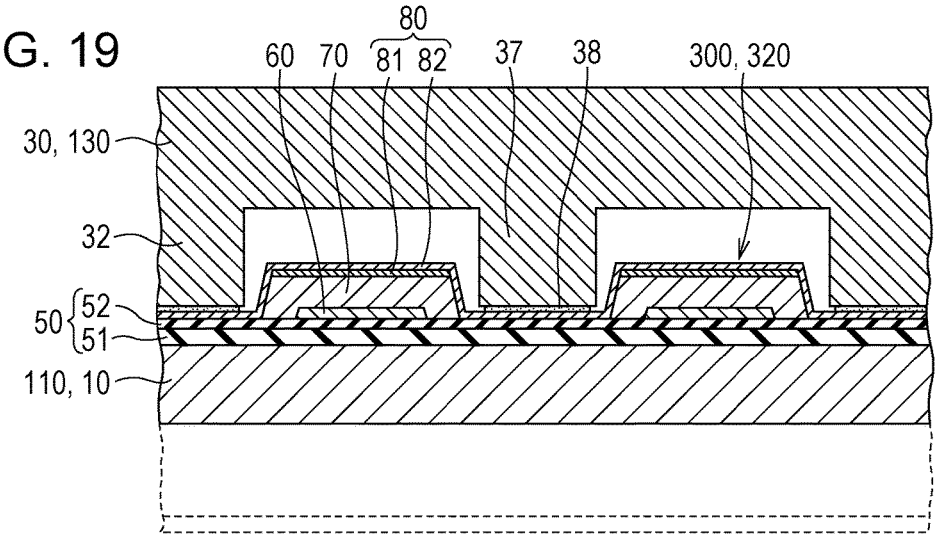
FIG. 19 is a cross-sectional diagram illustrating a method for producing a recording head according to Embodiment 1 of the invention.

Then, as illustrated in FIG. 19, a protective substrate wafer 130, which is a silicon wafer and is later to be cut into multiple protective substrates 30, is joined to the piezoelectric element 300 side of the flow channel substrate wafer 110 with an adhesive agent 38. The flow channel substrate wafer 110 is then thinned to a predetermined thickness.

At the same time, holding members 37 and the diaphragm 50 are joined together with the adhesive agent 38. The width of the adhesive agent 38 is adjusted not to exceed that of walls 11, which are later to be formed.

Figure 20:
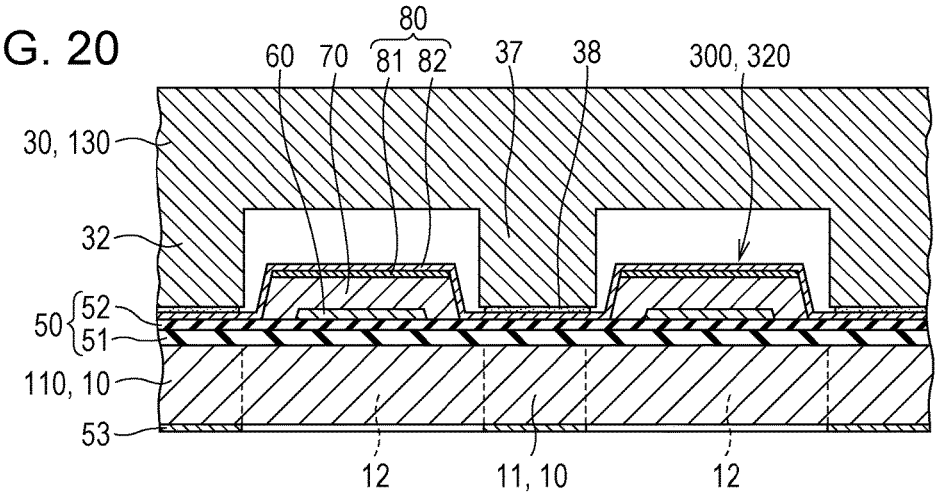
FIG. 20 is a cross-sectional diagram illustrating a method for producing a recording head according to Embodiment 1 of the invention.
Figure 21:
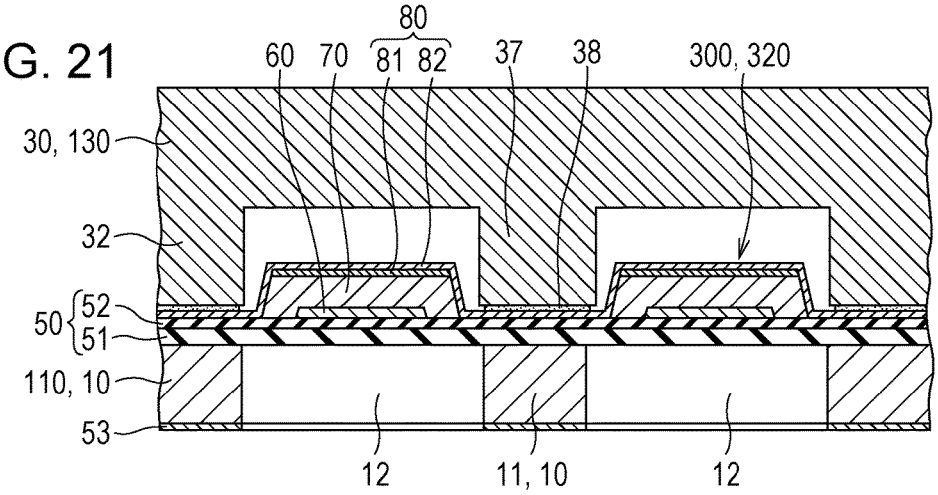
FIG. 21 is a cross-sectional diagram illustrating a method for producing a recording head according to Embodiment 1 of the invention.

Then, as illustrated in FIG. 20, a new mask coating 53 is formed on the flow channel substrate wafer 110 and patterned into a predetermined shape. Then, as illustrated in FIG. 21, the flow channel substrate wafer 110 is anisotropically etched using an alkali solution, such as a KOH solution (wet etching), with the mask coating 53 thereon. This creates pressure chambers 12 corresponding to the individual piezoelectric elements 300, as well as other features such as ink supply paths 13, communicating paths 14, and a communicating space 15.

Subsequently, the margins of the flow channel substrate wafer 110 and the protective substrate wafer 130 are removed, for example by cutting the wafers by dicing or any similar technique. A nozzle plate 20 drilled with nozzle openings 21 is then joined to the surface of the flow channel substrate wafer 110 opposite the protective substrate wafer 130, and compliance substrates 40 are joined to the protective substrate wafer 130. The whole structure including the flow channel substrate wafer 110 is divided into equal-sized chips each including a flow channel substrate 10 like one illustrated in FIG. 1, giving ink jet recording heads according to this embodiment.

EXAMPLES 1 to 10

Ink jet heads were produced by a method according to Embodiment 1 with different widths $W_2$ of the holding members 37. In the following, the width $W_2$ of the holding members 37 is expressed as the proportion of the width $W_3$ of the regions sticking out beyond the edges of the walls 11 to the width $W_1$ of the walls 11 (see Table 1).

Comparative Example 1

For comparison purposes, an ink jet recording head was produced in the same way as in the Examples but without the holding members 37.

Study 1

The piezoelectric elements 300 of Examples 1 to 10 and Comparative Example 1 were driven, and the maximum principal stress and the position of stress raisers were determined.

The maximum principal stress is a percentage relative to that in Comparative Example 1; the maximum principal stress in Comparative Example 1 is 100%. The position of stress raisers is a relative value that represents how much stress raisers moved to the regions facing the pressure chambers 12, and was determined by letting the position of stress raisers in Comparative Example 1, the boundaries between the walls and the pressure chambers, be 1.00. The results are presented in Table 1.

TABLE 1

| | $W_3/W_1$ | Maximum principal stress (vs. Comparative Example 1) | Position of stress raisers |
|---|---|---|---|
| Example 1 | 0 | 93% | 1.00 |
| Example 2 | 0.02 | 89% | 1.04 |
| Example 3 | 0.04 | 85% | 1.05 |
| Example 4 | 0.06 | 79% | 1.07 |
| Example 5 | 0.08 | 71% | 1.09 |
| Example 6 | 0.10 | 62% | 1.12 |
| Example 7 | 0.20 | 49% | 1.22 |
| Example 8 | 0.30 | 36% | 1.31 |
| Example 9 | 0.40 | 30% | 1.40 |
| Example 10 | 0.50 | 31% | 1.69 |
| Comparative Example 1 | — | 100% | 1.00 |

As shown in the results, providing holding members 37 reduces the maximum principal stress. Regarding the width of the holding members 37, the maximum principal stress was reduced to 93% even in Example 1, in which the holding members 37 had the same width as the walls 11. However, a proportion of the width of the portions sticking out beyond the edges of the walls 11 to the pressure chamber 12 side to the width of the walls 11 ($W_3/W_1$) of 0.06 or more resulted in a more than 20% decrease in maximum principal stress, a $W_3/W_1$ of 0.08 or more a nearly 30% decrease, a $W_3/W_1$ of 0.10 a nearly 40% decrease, and a $W_3/W_1$ of 0.20 or more a more than 50% decrease. It was also found that increasing the $W_3/W_1$ beyond 0.30 makes little change to the increase in the effectiveness of the holding members 37 in lowering the maximum principal stress. Furthermore, a $W_3/W_1$ of 0.30 or more is unfavorable for efficient arrangement of piezoelectric elements, because in such a design large arms are needed.

As for stress raisers, it was found that they move to positions almost right beneath the edges of the holding members 37.

It is therefore preferred that the $W_3/W_1$ be 0.02 or more and 0.30 or less, more preferably 0.04 or more and 0.30 or less, even more preferably 0.06 or more and 0.20 or less, although design limitations to the dimensions need to be considered.

Embodiment 2

Figure 22:
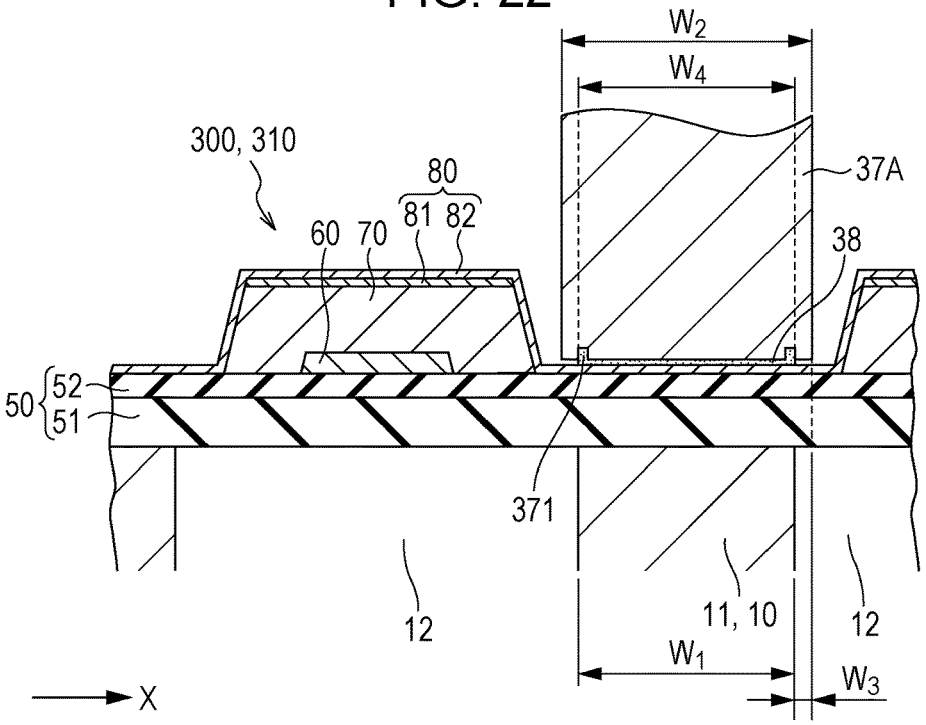
FIG. 22 is an enlarged cross-sectional view of some essential components of a recording head according to Embodiment 2 of the invention.

FIG. 22 is a cross-sectional view of some essential components of an ink jet recording head according to Embodiment 2. In this embodiment, as illustrated in FIG. 22, the holding members 37A have grooves 371 extending in the second direction Y near the ends in the first direction X of the interfaces with the diaphragm 50. The rest of the structure is the same as in Embodiment 1.

The grooves 371 limit the spread of the adhesive agent 38 in the first direction X and, therefore, limits the width $W_4$ of the adhesive agent 38, in the first direction X. More specifically, the grooves 371 catch excess adhesive agent 38 and prevent it from flowing over the grooves 371 to the regions facing the pressure chambers 12. Providing the grooves 371 will therefore prevent the displacement of the diaphragm 50 by the piezoelectric elements 300 from being obstructed.

Embodiment 3

Figure 23:
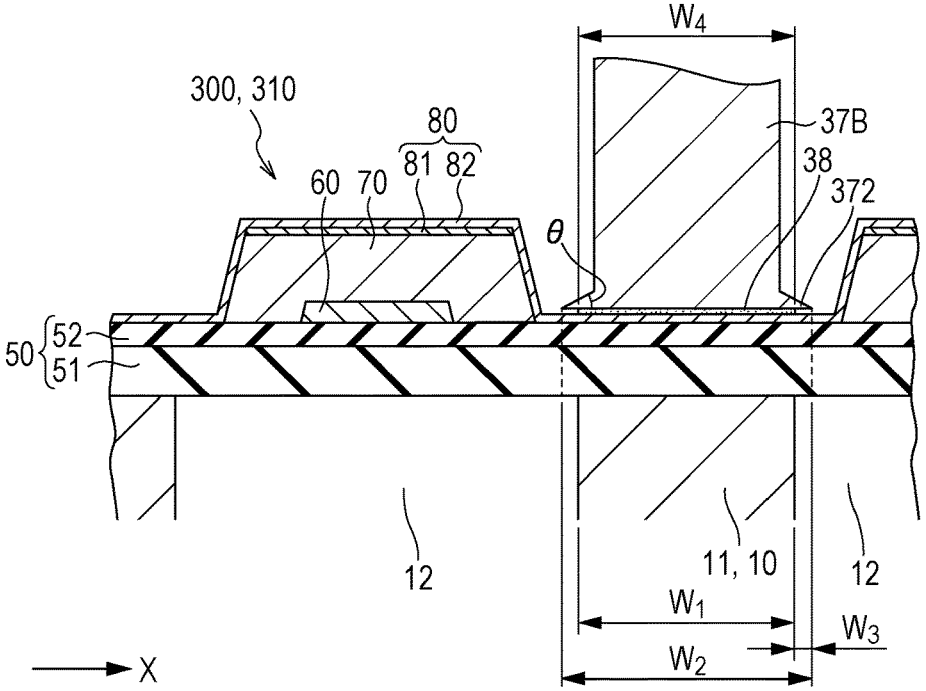
FIG. 23 is an enlarged cross-sectional view of some essential components of a recording head according to Embodiment 3 of the invention.

FIG. 23 is a cross-sectional view of some essential components of an ink jet recording head according to Embodiment 3. In this embodiment, as illustrated in FIG. 23, the structure is the same as in Embodiment 1 except that the side walls, or the walls on the sides in the first direction X, of the holding members 37B is sloping, or not at an angle of 90°, in the vicinity of the interfaces with the diaphragm 50. By changing the angle θ between the interfaces and the side walls 372 in this way, the magnitude of the maximum principal stress can be changed and, therefore, controlled.

Examples 11 to 23

Ink jet heads were produced by a method according to Embodiment 1 with different angles θ of the holding members 37B. The width $W_2$ of the holding members 37B was such that the proportion of the width $W_3$ of the regions sticking out beyond the edges of the walls 11 to the width $W_1$ of the walls 11 would be 0.10 (see Table 2).

Comparative Example 2

For comparison purposes, an ink jet recording head was produced in the same way as in the Examples but without the holding members 37B.

Study 2

The piezoelectric elements 300 of Examples 11 to 23 and Comparative Example 2 were driven, and the maximum principal stress and the position of stress raisers were determined.

The maximum principal stress is a percentage relative to that in Comparative Example 2; the maximum principal stress in Comparative Example 2 is 100%. The position of stress raisers is a relative value that represents how much stress raisers moved to the regions facing the pressure chambers 12, and was determined by letting the position of stress raisers in Comparative Example 2, the boundaries between the walls and the pressure chambers, be 1.00. The results are presented in Table 2.

TABLE 2

| | $W_3/W_1$ | Angle θ (deg.) | Maximum principal stress (vs. Comparative Example 2) | Position of stress raisers |
|---|---|---|---|---|
| Example 11 | 0.10 | 5 | 99.29% | 1.07 |
| Example 12 | 0.10 | 10 | 97.68% | 1.07 |
| Example 13 | 0.10 | 15 | 96.74% | 1.07 |
| Example 14 | 0.10 | 30 | 95.05% | 1.07 |
| Example 15 | 0.10 | 45 | 94.13% | 1.07 |
| Example 16 | 0.10 | 60 | 93.57% | 1.07 |
| Example 17 | 0.10 | 75 | 93.25% | 1.07 |
| Example 18 | 0.10 | 80 | 93.19% | 1.07 |
| Example 19 | 0.10 | 85 | 93.14% | 1.07 |
| Example 20 | 0.10 | 90 | 93.08% | 1.07 |
| Example 21 | 0.10 | 95 | 92.90% | 1.07 |
| Example 22 | 0.10 | 135 | 92.63% | 1.07 |
| Example 23 | 0.10 | 150 | 92.46% | 1.07 |
| Comparative Example 2 | — | — | 100% | 1.00 |

As shown in the results, by varying the angle θ of the holding members 37B, the maximum principal stress can be changed without varying the width $W_3$, and, therefore, the maximum principal stress most suitable for the design can be selected. Holding members 37B with an angle θ of 5° lowered the maximum principal stress only to a small extent, indicating that it is preferred to make the angle θ 10° or more. Holding members 37B with an obtuse angle θ can interfere with the piezoelectric elements 300, therefore unfavorable for efficient arrangement of the piezoelectric elements 300, and making the angle θ obtuse makes little change to the effectiveness of the holding members 37B in lowering the maximum principal stress. It is, therefore, preferred that the angle θ be 135° or less.

Other Embodiments

The foregoing is some embodiments of an aspect of the invention and is not the only possible basic structure of that aspect of the invention.

For example, the active portions 310 in the described embodiments share a continuous piezoelectric layer 70, but naturally, the piezoelectric layer 70 may be divided into segments independent of one another and corresponding to the active portions 310. Likewise, although in Embodiment 1 the second electrode 80 serves as a common electrode for multiple active portions 310 and the first electrode 60 provides separate electrodes corresponding to these active portions 310, this is not the only possible choice. For example, the first electrode 60 may serve as a common electrode for multiple active portions 310, and the second electrode 80 may provide separate electrodes corresponding to these active portions 310. In a configuration in which the first electrode 60 serves as a common electrode for multiple active portions 310, the diaphragm 50 may be, for example, the first electrode 60 provided alone, having no elastic film 51 or insulating film 52 because the first electrode 60 extends over the multiple active portions 310. Furthermore, the piezoelectric elements 300 themselves may practically serve as the diaphragm 50, regardless of whether the first electrode 60 provides separate electrodes as in Embodiment 1 or the first electrode 60 serves as a common electrode. If the first electrode 60 is formed directly on the flow channel substrate 10, however, it is preferred to protect the first electrode 60, for example with an insulating protective film, to prevent electricity from flowing from the first electrode 60 to the ink. When it is herein stated that the first electrode 60 is formed on the substrate (flow channel substrate 10), therefore, it means that the electrode can be on the substrate directly or with any other component interposed therebetween (i.e., above the substrate).

Furthermore, the second electrode 80 in the described embodiments is a stack of a first layer 81 and a second layer 82, but this is not the only possible structure of this electrode. The second electrode 80 may be a single layer or a stack of three or more layers.

To take another example, the piezoelectric films 74 in the described embodiments are each produced by forming a precursor piezoelectric coating 73, drying the formed coating, degreasing the dried coating, and then firing the degreased coating, but this is not the only way of producing these films. For example, the piezoelectric films 74 may be formed by performing more than one cycle, for example two cycles, of forming a precursor piezoelectric coating 73, drying the formed coating, and degreasing the dried coating, and then firing the degreased coatings.

Moreover, the inner walls of the pressure chambers 12, ink supply paths 13, communicating paths 14, and communicating space 15 may be coated with a protective film, such as a layer of tantalum oxide.

Figure 24:
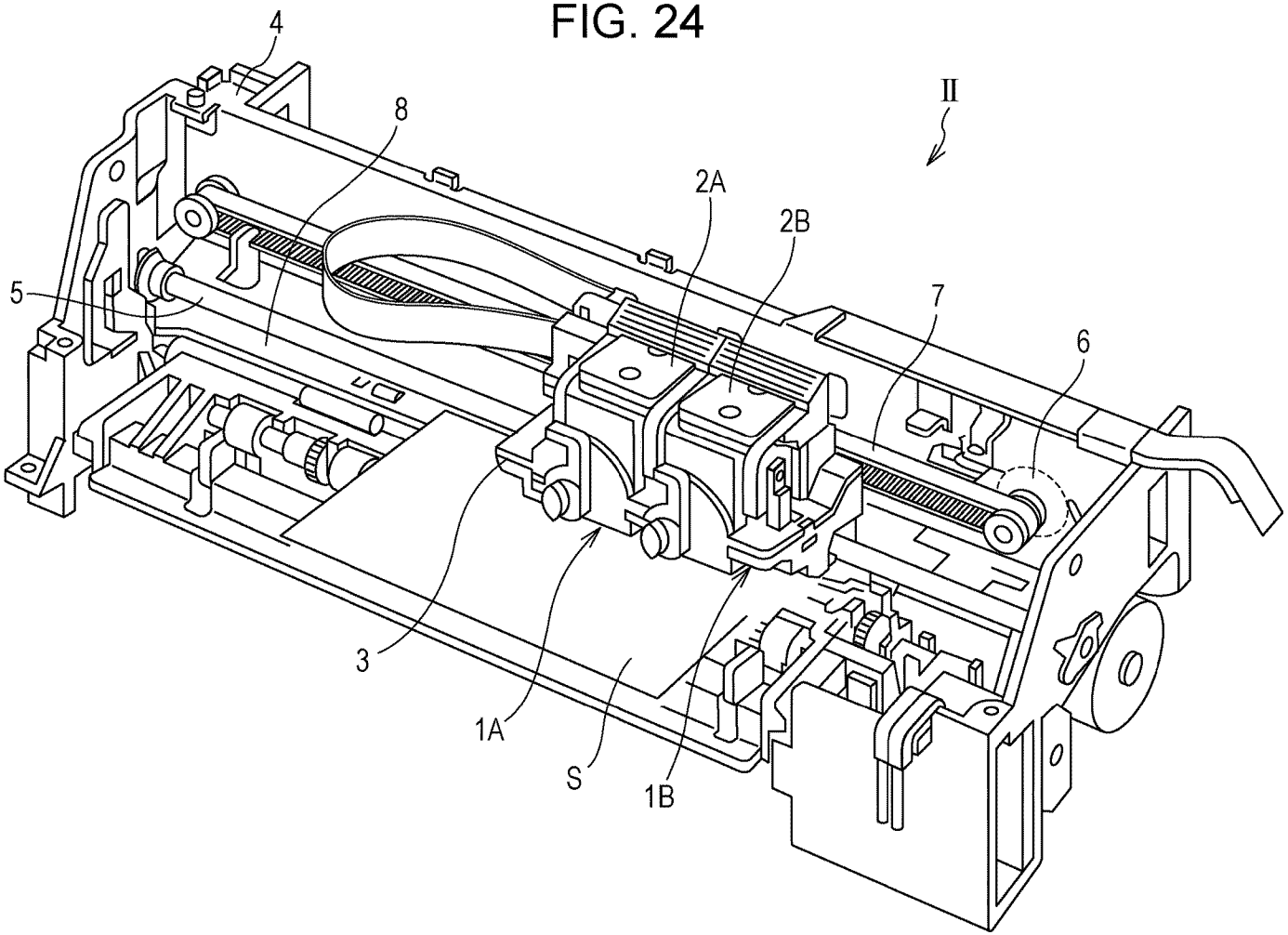
FIG. 24 is a schematic view of a liquid ejecting apparatus according to an embodiment of the invention.

The ink jet recording head I is installed in, for example, an ink jet recording apparatus II, as illustrated in FIG. 24. Recording head units 1A and 1B each including an ink jet recording head I are equipped with detachable cartridges 2A and 2B, from which inks are supplied. A carriage 3 with the recording head units 1A and 1B thereon can move along a carriage shaft 5 installed in the main unit 4. The recording head units 1A and 1B eject, for example, a black ink composition and a color ink composition.

The power of a motor 6 is transmitted through not-illustrated cogwheels and a timing belt 7 to the carriage 3, moving the carriage 3, with the recording head units 1A and 1B thereon, along the carriage shaft 5. The main unit 4 also has a platen 8 that extends along the carriage shaft 5. A recording sheet S, which is the substrate for recording (e.g., a sheet of paper) is fed, for example by not-illustrated feeding rollers, and is transported by the platen 8.

By virtue of an aspect of the invention, as described above, the piezoelectric elements 300 as a component of the ink jet recording heads I are unlikely to break, and the heads are uniform in terms of ejection properties. As a result, the ink jet recording apparatus II is better in print quality and durability than known ones.

It should be understood that although in the illustrated ink jet recording apparatus II the ink jet recording heads I move on the carriage 3 in the primary scanning direction, this is not the only possible configuration. For example, the ink jet recording apparatus II can be what is called a line-head recording apparatus, which performs printing by holding the ink jet recording heads I in fixed positions and moving the recording sheet S, such as a sheet of paper, in the secondary scanning direction.

Furthermore, the above embodiments describe an aspect of the invention by taking ink jet recording heads as an example of liquid ejecting heads, but that aspect of the invention encompasses liquid ejecting heads in general. Examples include recording heads for printers or other image recording apparatuses, colorant ejecting heads for the production of color filters for liquid crystal displays or other displays, electrode material ejecting heads for the formation of electrodes for organic EL displays, FEDs (field emission displays), or other displays, and bioorganic substance ejecting heads for the production of biochips.

In addition to such liquid ejecting heads (ink jet recording heads), the invention can be applied to actuators for every kind of apparatus. Actuators according to an aspect of the invention can be used in, for example, sensors.

What is claimed is:

1. A liquid ejecting head comprising:

a flow channel substrate including pressure chambers lined up in a first direction with walls therebetween, the pressure chambers communicating with nozzle openings, openings through which a liquid is ejected; and piezoelectric elements on one side of the flow channel substrate with a diaphragm between the piezoelectric elements and the flow channel substrate, each piezoelectric element including a first electrode, a piezoelectric layer above the first electrode, and a second electrode above the piezoelectric layer, wherein:

each piezoelectric element has a piezoelectrically active portion, a region in which the piezoelectric layer is sandwiched between the first electrode and the second electrode, and the piezoelectrically active portions are provided in regions facing the pressure chambers;

the liquid ejecting head further includes holding members joined one-to-one to regions of the diaphragm facing the walls between the pressure chambers using an adhesive agent; a width, or a dimension measured in the first direction, of the holding members is equivalent to or larger than a width of the walls; and a width, or a length measured in the first direction, of an adhesive agent with which the holding members are joined to the diaphragm is equal to or smaller than the width of the walls.

2. The liquid ejecting head according to claim 1, wherein:

the liquid ejecting head further includes a protective substrate joined to the side of the flow channel substrate on which the piezoelectric elements are provided, the protective substrate including a piezoelectric element housing, a space in which the piezoelectric elements are housed; and the holding members are provided on the protective substrate, whether integral with or separate from the protective substrate.

3. A liquid ejecting apparatus comprising the liquid ejecting head according to claim 2.

4. The liquid ejecting head according to claim 1, wherein a proportion $W_3/W_1$, where $W_3$ is a dimension measured in the first direction of portions of the holding members sticking out beyond edges of the walls to a pressure chamber side, and $W_1$ is the width of the walls, is 0.02 or more and 0.50 or less.

5. A liquid ejecting apparatus comprising the liquid ejecting head according to claim 4.

6. The liquid ejecting head according to claim 1, wherein side walls, or walls on sides in the first direction, of the holding members and interfaces between the holding members and the diaphragm form an angle of 10° or more and 135° or less in a vicinity of the interfaces.

7. A liquid ejecting apparatus comprising the liquid ejecting head according to claim 6.

8. A liquid ejecting apparatus comprising the liquid ejecting head according to claim 1.

* * * * *